US010202732B2

(12) United States Patent
van den Berg

(10) Patent No.: US 10,202,732 B2
(45) Date of Patent: Feb. 12, 2019

(54) EROSION PREVENTION PLANK WITH INTERIOR LATTICE

(71) Applicant: Andre van den Berg, Fort Lauderdale, FL (US)

(72) Inventor: Andre van den Berg, Fort Lauderdale, FL (US)

(73) Assignee: MELBERG INDUSTRIES, LLC

( * ) Notice: Subject to any disclaimer, the term of this patent is extended or adjusted under 35 U.S.C. 154(b) by 186 days.

(21) Appl. No.: 14/197,509

(22) Filed: Mar. 5, 2014

(65) Prior Publication Data

US 2014/0255097 A1 Sep. 11, 2014

Related U.S. Application Data

(60) Provisional application No. 61/772,668, filed on Mar. 5, 2013.

(51) Int. Cl.
*E02B 3/12* (2006.01)
*E02D 17/20* (2006.01)

(52) U.S. Cl.
CPC ..... *E02D 17/20* (2013.01); *E02B 3/122* (2013.01)

(58) Field of Classification Search
USPC ..... 405/15–17, 302.4, 302.6, 302.7
See application file for complete search history.

(56) References Cited

U.S. PATENT DOCUMENTS 1,905,176 A 4/1933 Kieckhefer
2,143,461 A 1/1939 Waring
2,261,715 A 11/1941 Clark
4,118,892 A * 10/1978 Nakamura ..... A01G 9/025 47/65.9
4,181,450 A 1/1980 Rasen et al.
4,610,568 A 9/1986 Koerner
4,655,637 A * 4/1987 Vignocchi ..... E02B 3/12 405/15
4,717,283 A 1/1988 Bach
4,726,708 A 2/1988 Papetti
4,785,604 A * 11/1988 Johnson, Jr. ..... E02D 17/202 404/36

(Continued)

FOREIGN PATENT DOCUMENTS

JP 06158665 * 7/1994

*Primary Examiner* — Sean D Andrish

(74) *Attorney, Agent, or Firm* — Robert M. Schwartz; Alfred K. Dassler

(57) ABSTRACT

An erosion control plank is provided. The plank is a lattice of intersecting vertical walls and horizontal walls and includes an opening to permit a stake to secure the plank over an eroded region. The plank can be secured by a stake. The eroded region is filled with appropriate fill material which would pass through the lattice. Plants and other growth are introduced onto the plank and fill material on or through the lattice where their root networks would help secure the fill and the plank and prevent erosion. The plank is rectangular and includes connectors to permit multiple planks to be secured to one another in both a horizontal and vertical relationship, allowing the erosion control planks to fit over any of a variety of eroded surfaces and to prevent erosion from occurring there again. The erosion control planks may also be used on a non-eroded area to prevent the onset of erosion.

8 Claims, 15 Drawing Sheets

(56) References Cited

U.S. PATENT DOCUMENTS

| | | | | |
|---|---|---|---|---|
| 5,066,353 | A * | 11/1991 | Bourdo | E02B 3/04 156/300 |
| 5,358,356 | A | 10/1994 | Romanek et al. | |
| 5,876,151 | A | 3/1999 | Brown, III et al. | |
| 5,951,202 | A | 9/1999 | Brown | |
| 6,305,875 | B1 | 10/2001 | Matsumoto | |
| D471,679 | S * | 3/2003 | Henzey | D32/3 |
| 6,554,545 | B1 | 4/2003 | Hall | |
| 7,175,369 | B2 * | 2/2007 | Fomenkov | E02D 5/04 405/277 |
| 2006/0002772 | A1 * | 1/2006 | Tabler | E01F 7/02 405/302.7 |
| 2006/0078385 | A1 | 4/2006 | Watchorn | |
| 2009/0317190 | A1 | 12/2009 | Carpenter | |
| 2010/0143049 | A1 | 6/2010 | Heselden | |
| 2011/0044759 | A1 | 2/2011 | Lancaster | |
| 2011/0248137 | A1 | 10/2011 | Barba | |
| 2012/0257926 | A1 * | 10/2012 | De Giuseppe | B29D 28/00 404/76 |

* cited by examiner

5H

10

J
J
b
12A
12
12
12
12B
12B
10
a
12A

H
H
10

C
d
12
12
12b
12b
b
12b
e

EROSION PREVENTION PLANK WITH INTERIOR LATTICE

PRIORITY DOCUMENTS

This application claims priority of U.S. Provisional Patent Application Ser. No. 61/772,668 filed on Mar. 5, 2013, entitled Erosion Prevention Plank With Interior Lattice, which is incorporated herein by reference in its entirety.

BACKGROUND OF THE INVENTION

Sloped regions near ponds, lakes, streams, rivers, canals, seashore and the like are subject to erosion due to rain and other physical processes. The rate of erosion is amplified when the natural habitat of vegetation which is indigenous to the region is reduced or eliminated. During a rainstorm, a portion of valuable topsoil as well as property (the ground) adjacent to such regions ends up in the body of water. This happens when the runoff from the rainstorm carries soil and other material down a slope and into a pond, canal or lake water. This process forms gullies about the perimeter of the pond or water pool which accelerates the rate of erosion during subsequent rainfall. Depending on how close a home or building is to the pond or lake, unchecked erosion may eventually be damaging to such structures.

BRIEF DESCRIPTION OF THE INVENTION

The invention is comprised of an elongated grate which may be connected to one or more adjacent grates, forming a lattice like structure which would be applied atop an erosion region or gully around a pond, lake or other area where erosion is not desired. This permits the erosion region surrounding a pond lake or other area where erosion is not desired to be completely covered by a plurality of interlocked grates. Once the grates are in position over the eroded area, sand, crushed rock, or other ASTM® (a registered trademark of American Society for Testing and Materials Corporation) approved materials will be placed atop the lattice, where they in turn would fill the eroded space below the grate. Once the eroded space is filled with new material, sod with grasses or other plants would be placed atop or in the grates. The growth of the plant life would both secure the grate to the material below, as well as stabilize the fill material by their root systems, securing the grates and the material beneath, preventing such material from erosion. The invention is not limited to any dimensions described herein, but may be any dimension which would be applicable to stopping erosion with such a device or method.

The invention is not limited to any dimensions described herein, but may be any dimension which would be applicable to stopping erosion with such a device or method.

DETAILED DESCRIPTION OF THE PREFERRED EMBODIMENT

Figures 1A, 1B, 1C, 1D, 1E:
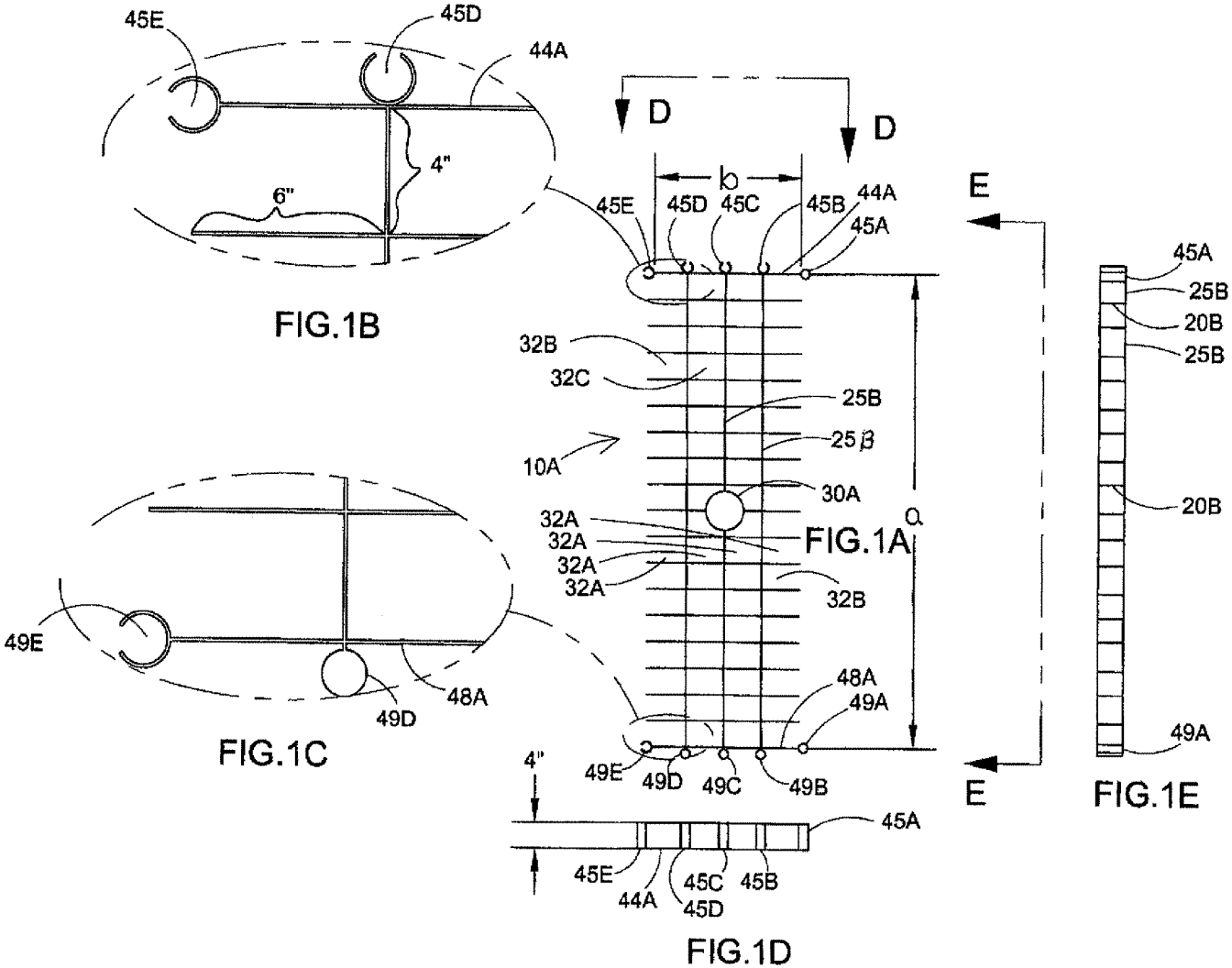
FIG. 1A is a plan view a first embodiment of the erosion control plank showing linear lattice structure.
FIG. 1B is an exploded view of a top left corner of FIG. 1A showing a first embodiment of the erosion control plank's female connection elements.
FIG. 1C is an exploded view of a bottom left corner of FIG. 1A showing a first embodiment of the erosion control plank's female and male connection elements.
FIG. 1D is the short side view of the first embodiment of the erosion control plank taken along lines D-D of FIG. 1A.
FIG. 1E is a long side view of the first embodiment the erosion control plank taken along line E-E of FIG. 1A.
Figure 7:
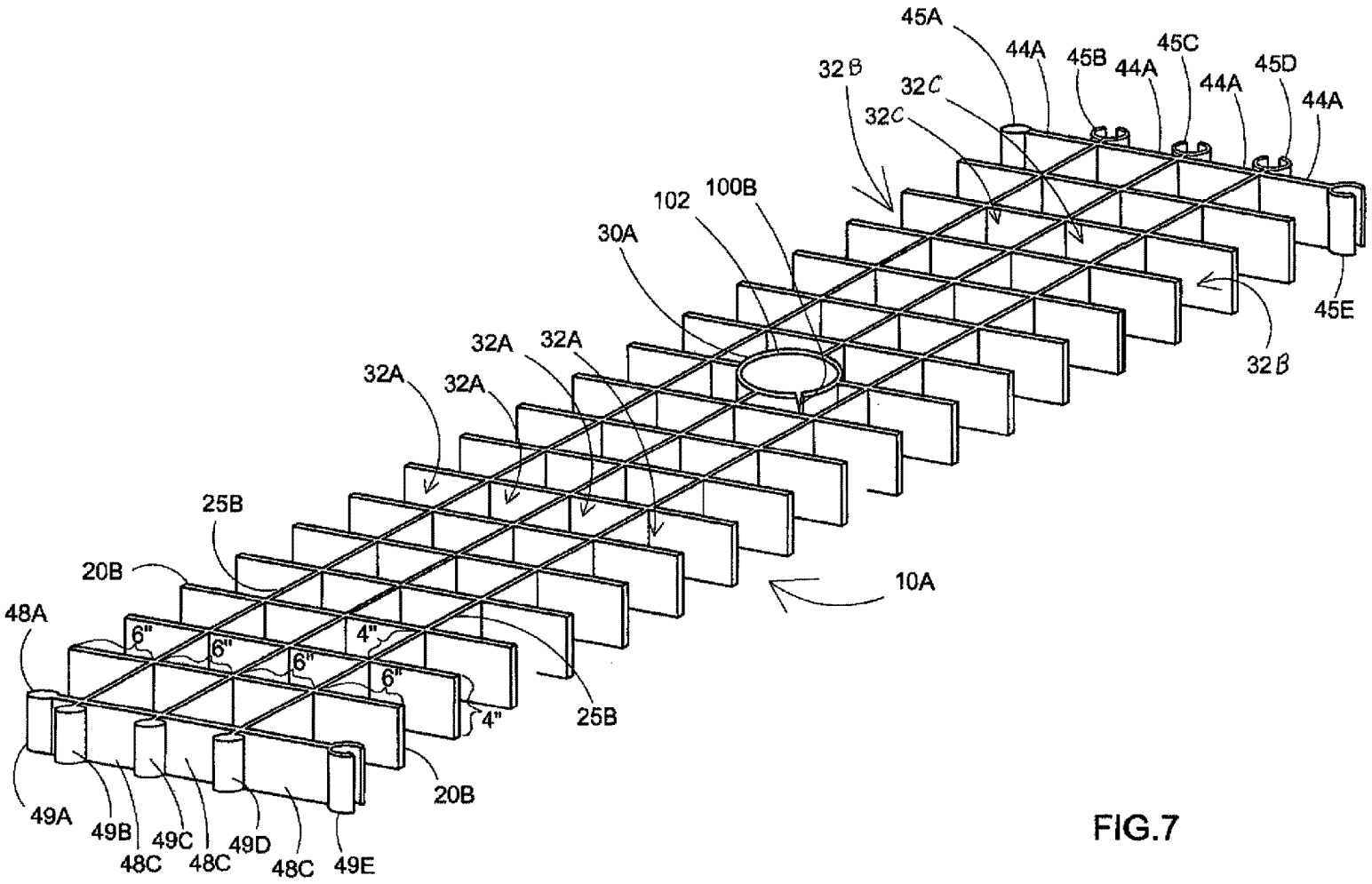
FIG. 7 is a perspective view of the first embodiment of the erosion control plank.
Figure 13:
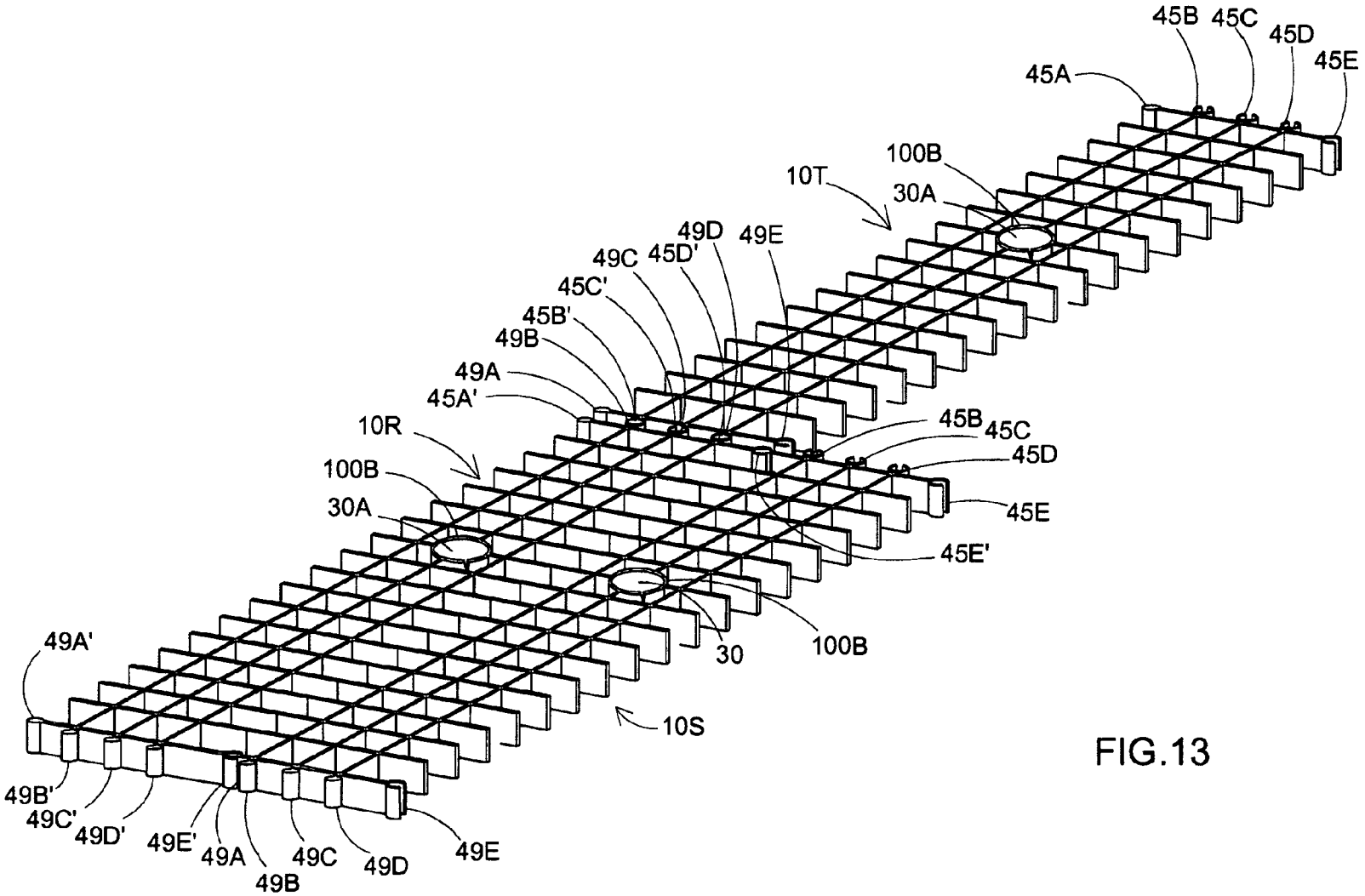
FIG. 13 shows three erosion control planks of the first embodiment of the invention connected both horizontally and vertically.

Referring to FIG. 1A, FIG. 7, and FIG. 13 a first embodiment of the erosion control plank 10A is shown. The erosion control plank 10A is a lattice of a plurality of horizontal walls 20B intersecting with a plurality of vertical walls 25B. In the approximate center of the erosion control plank 10A is a cylindrical aperture 30A adapted to receive a stake or other means to secure the erosion control plank 10A in place. However, aperture 30A can be located anywhere within the horizontal wall and vertical wall borders of plank 10A. Cylindrical aperture 30A has a v-shaped notch 100B in it's sidewall 102 which would receive a securing means such as rope 120 therein (best seen in FIG. 10). The lattice is comprised of a plurality of cells 32A which may be an open cell 32B or a closed cell 32C. All cells may be referred to as 32A. Open cells 32B are the cells which border both the right and left side of the erosion control plank 10A and have three sidewalls and one opening. Closed cells 32C have four sidewalls. Both open cells 32B and closed cells 32C have an approximate dimension of 6 inches in width, 4 inches in length and 4 inches in depth or height as shown in FIGS. 1B and 1D. The top most horizontal wall 44A includes five connection elements. The rightmost connection element is 45A, which is adjacent connection element 45B, which is adjacent to connection element 45C, which in turn is adjacent to connection element 45D, which in turn is adjacent to the leftmost connection element 45E. Connection element 45A is a male connection element, whereas connection elements 45B, 45C, 45D, and 45E are female connection elements.

The bottom most horizontal wall 48A also includes 5 connection elements. The rightmost connection element is 49A, which in turn is adjacent to connection element 49B, which in turn is adjacent to connection element 49C, which in turn is adjacent to connection element 49D, which in turn is adjacent to the leftmost connection element 49E. Connection element 49A is a male connection element, whereas connection elements 49B, 49C, 49D, and 49E are all female connection elements.

The rightmost connection element and the leftmost connection element of all the horizontal walls intermediate the topmost horizontal wall 44A and the bottommost horizontal wall 48A end at a point approximately 6" from the closest vertical wall. This gives the erosion control plank 10A, eighteen (18) open cells in the leftmost column, eighteen (18) closed cells in the second column, eighteen (18) closed cells in the third column, and eighteen (18) open cells in the fourth column.

If an identical erosion control plank 10A were placed to the right of a first erosion control plank 10A, the top male connection element 45A and the bottom male connection element 49A would connectively interfit with the top female connection element 45E and the bottom female connection element 49E connecting the first and second erosion control planks together in a horizontal relationship. Three such erosion control planks are shown connected in FIG. 2A.

Referring now specifically to FIG. 1B a closeup of the left most top portion of the erosion control plank 10A is shown. The left most top female connection element 45E is shown oriented to the left end of the topmost horizontal wall 44A. The left most top female connection element 45E is shown proximal to the upward facing female connection element 45D which lies at the intersection of the top of the leftmost vertical wall and the topmost horizontal wall 44A.

Although not shown in FIG. 1B, the orientation of the two adjacent top female connector elements 45C and 45D are also upwardly oriented from where the central vertical wall intersects the topmost horizontal wall 44A and where the rightmost vertical wall intersects the topmost horizontal wall 44A respectively.

Referring now specifically to FIG. 1C a closeup of the left most bottom portion of the erosion control plank 10A is shown. The left most bottom female connection element 49E is shown oriented to the left of the bottom most horizontal wall 48A. The left most bottom female connection element 49E is shown proximal to the upward facing female connection element 49D which lies at the intersection of the bottom of the leftmost vertical wall and the bottom most horizontal wall 48A.

Although not shown in FIG. 1C, the orientation of the two adjacent bottom male connector elements 49C and 49D are also downwardly oriented from where the central vertical wall intersects the bottom most horizontal wall 48A and where the rightmost vertical wall intersects the bottom most horizontal wall 48A respectively.

Referring now to FIG. 1D a view of the erosion control plank 10A is shown taken along lines D-D of FIG. 1A. Female connector elements 45E, 45D, 45C and 45B are shown in series and adjacent to male connector element 45A along the topmost horizontal wall 44A.

A view of the bottom most horizontal wall 48A upward would show the female connector element 49E being all the way to the left, followed by male connectors 49D, 49C, 49B, and 48A as one moves to the right. These bottom connectors have the orientation as shown in FIG. 1A.

Referring specifically to FIG. 1E, a view of the erosion control plank 10A is shown taken along lines E-E of FIG. 1A. Both the topmost male connector 45A and the bottommost male connector 49A are shown. Both the topmost male connector 45A and the bottom most male connector 49A are shown centrally affixed to the right end of the topmost horizontal wall 44A and to the right end of the bottom most horizontal wall 48A. FIG. 1E also shows elements of the rightmost open cells of the lattice which are formed of vertical element 25B and horizontal elements 20B.

Figures 1F, 1G, 1H, 1I, 1J:
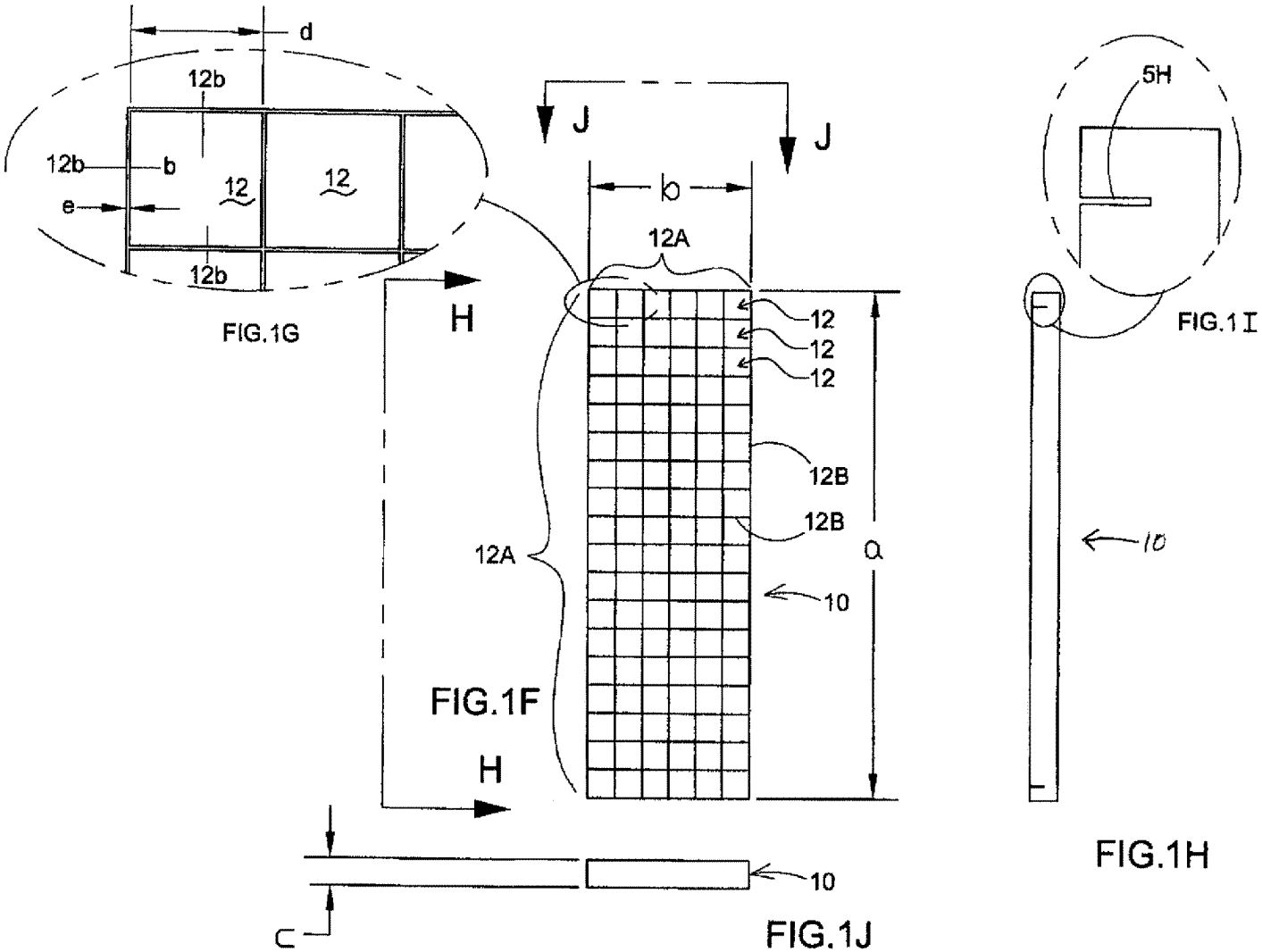
FIG. 1F is a top plan view of a second embodiment of the erosion control plank.
FIG. 1G is an exploded view of the upper left hand corner of the second embodiment of the erosion control plank showing a close-up of the lattice structure.
FIG. 1H is a side view of the long side of a second embodiment of the erosion control plank taken along line H-H of FIG. 1F.
FIG. 1I is an exploded view of a second embodiment of the erosion control plank taken from a top portion of FIG. 1H, showing the slot through which a connecting element of an attachment stake will pass.
FIG. 1J is a short side view of a second embodiment of the erosion control plank taken from line J-J FIG. 1F.

Referring to FIG. 1F a plan view of the second embodiment of the erosion control plank 10 showing a row and columns of a linear lattice or lattice structure 12A, the linear lattice 12A having a plurality of cells 12. In this embodiment of the invention, the erosion control plank 10 is about 72 inches long, see length "a", and 24 inches wide, see width "b" and 4 inches high, see height "c" (best seen in FIG. 1J). This gives the erosion control plank 10 one hundred and eight 4 inch by 4 inch cells, in combination, is referred to as the linear lattice structure 12A. Each sidewall 12B of lattice structure 12A including the length, width and individual cell 12 sidewall 12B has a dimension of 0.1 inch, and is also referred to as the width of the lattice wall or "e" dimension in FIG. 1G. The erosion control plank 10 are manufactured from any of a plurality of modern high strength plastics or other material which may have appropriate material properties to be employed, including recycled materials.

FIG. 1G is an exploded view of the upper left hand corner of the second embodiment of the erosion control plank 10 showing a close-up of the lattice cells 12. Each individual cell 12 has 4 sidewalls 12B which have a thickness dimension of about 0.1 inch, and is also referred to as the lattice wall width or "e" dimension.

Referring now specifically to FIG. 1H a side view taken along line H-H of FIG. 1F from the left side toward the erosion control plank 10 is shown. A pair of slots 5H are shown on the top and the bottom of FIG. 1H. FIG. 1H would be identical if the lines H-H were taken from the right side toward the erosion control plank 10 including the concurrent pair of slots 5H. Slot 5H is slightly larger than 0.2 inches in width and is adapted to frictionally fit connecting element 82 of stakes 80 (best seen in FIGS. 2B, 3A and 3B) which would connect one erosion control plank to another (as best seen in FIG. 2B).

Referring now specifically to FIG. 1J a top side view taken along line J-J of FIG. 1F is shown.

The dimensions shown and discussed for the planks 10 and 10A and stakes 80 and the embodiments shown in FIGS. 1A through 1J are for a specific embodiment of the invention. Different erosion faces and types of materials eroded may necessitate other dimensions or materials to be employed. Further, the materials utilized are not intended to be any way limiting.

Figure 2A:
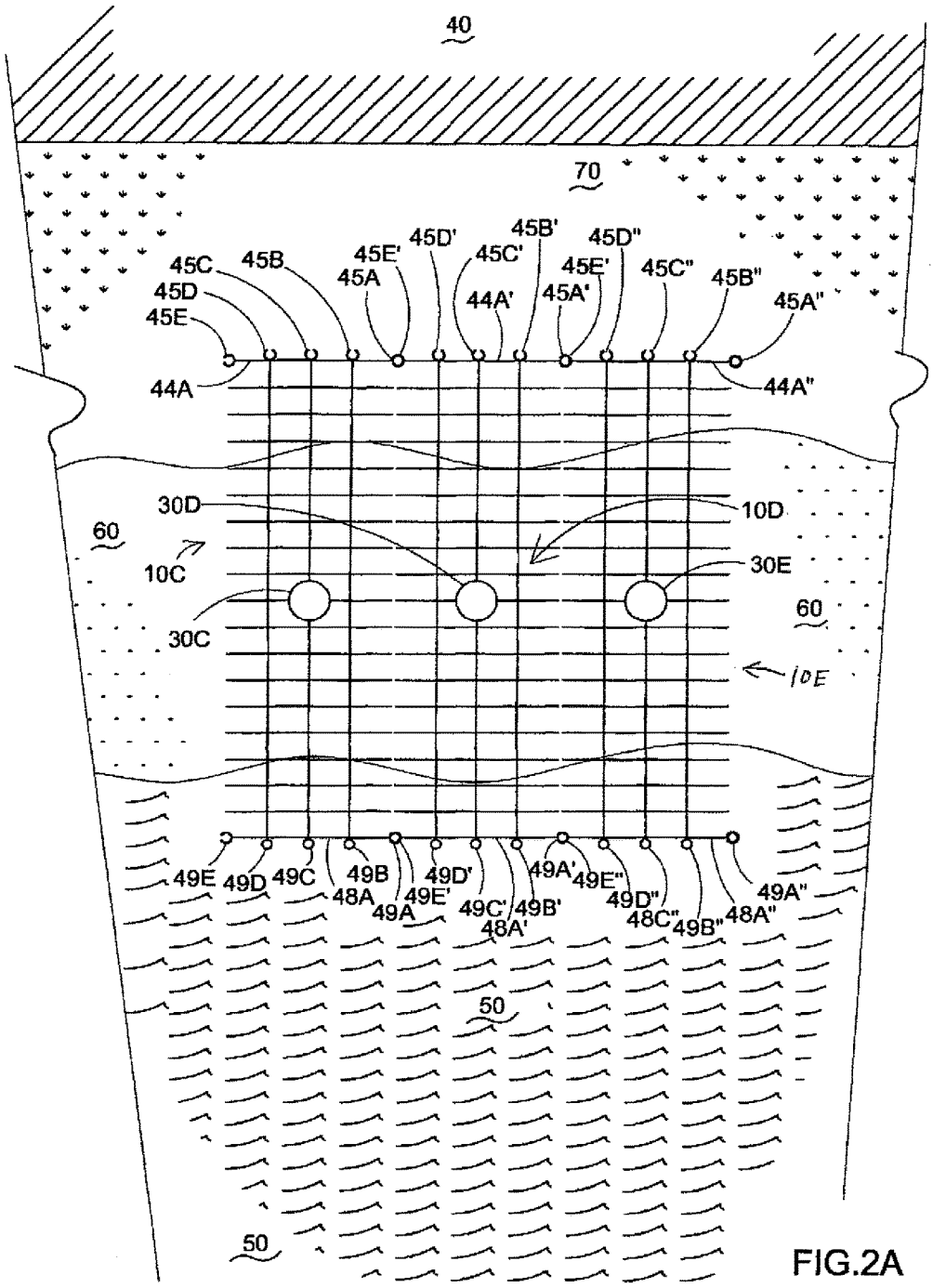
FIG. 2A is a top view of a plurality of the first embodiment of the erosion control planks connected together atop an erosion prone region.
Figure 2B:
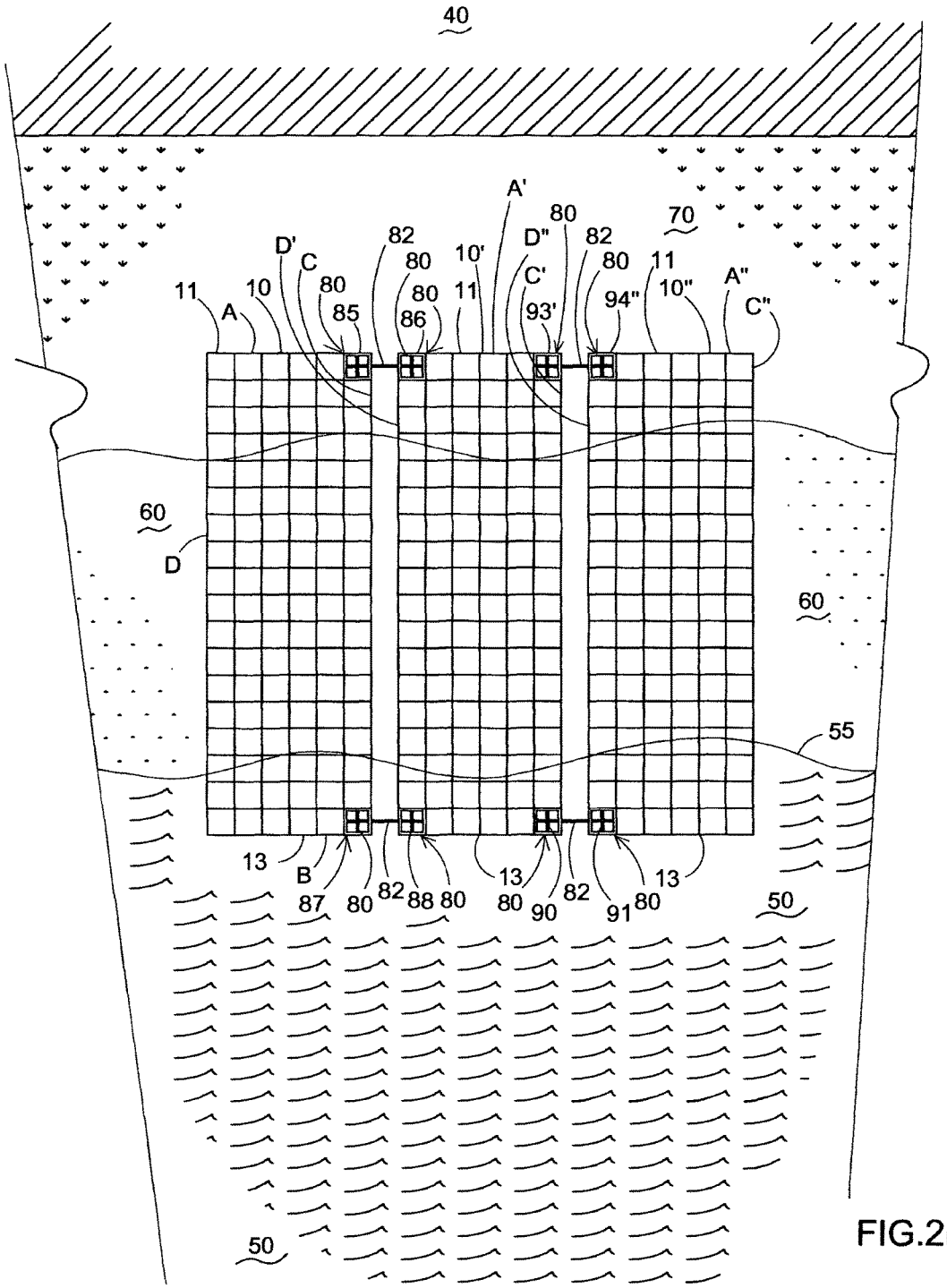
FIG. 2B is a top view of a plurality of the second embodiment of the erosion control planks connected together atop an erosion prone region.

Referring now to FIG. 2A, a plan view of three (3) erosion control planks 10C, 10D, and 10E being connected together atop an eroded region or zone 60 intermediate a lake, canal or pond 50 and a house 40 is shown. Grass 70 is shown intermediate the house 40.

The three erosion control planks 10C, 10D, and 10E of the first embodiment are shown connected together horizontally. A first cylindrical aperture 30C is provided on the center of the first erosion control plank 10C. A second cylindrical aperture 30D is provided on the center of the second erosion control plank 10D. A third cylindrical aperture 30E is provided on the center of the first erosion control plank 10E.

Erosion control planks 10C, 10D, and 10E are placed atop the eroded zone 60, and they are secured together on the top and bottom by a male securing element mating with a female securing element. First erosion control plank 10C is secured to the second erosion control plank 10D by the topmost right male connector element 45A of plank 10C matingly engaging the topmost left female connector element 45E' of plank 10D. Additionally, the first erosion control plank 10C is further secured to the second erosion control plank 10D by the bottommost right male connector element 49A matingly engaging the bottommost left female connector element 49E' of plank 10D. Second erosion control plank 10D is secured to the third erosion control plank 10E by the topmost right male connector element 45A' of plank 10D matingly engaging the topmost left female connector element 45E" of plank 10D. Additionally, the second erosion control plank 10D is further secured to the third erosion control plank 10E by the bottommost right male connector element 49A' matingly engaging the bottommost left female connector element 49E" of plank 10E.

The first circular aperture 30C, the second circular aperture 30D and the third circular aperture 30E are adapted to receive a stake or other securing elements there through, which would pass through the eroded region beneath the horizontally connected erosion control planks 10C, 10D, and 10E, with this stake penetrating onto the non-eroded subsurface which is covered by the connected planks, 10C, 10D, and 10E.

Once the erosion control planks 10C, 10D, and 10E are placed and staked in the proper position, a fill is poured through the lattice of the three planks 10C, 10D, and 10E which fills the eroded region 60 beneath the planks up to the top of the lattice walls. At this point, appropriate plants are introduced into the fill in and below the lattice walls, allowing the roots to grow and eventually permanently secure the eroded region 60 using the structure of the planks 10C, 10D, and 10E to hold the plants 240 and fill materials in position. The plants 240 can be chosen depending on the water type (salt, brackish or fresh) for hardiness as well as for deep root structure.

All of the connector elements, both male and female, both top and bottom are shown in FIG. 2A. This is merely an amplification of the single erosion control plank 10A, where the connection elements are non-primed on plank 10C, single primed on plank 10D and double primed on plank 10E.

Referring now to FIG. 2B, a view of three (3) erosion control planks 10 being connected together atop an eroded region 60 intermediate a lake, canal or pond 50 and a house 40 is shown. Grass 70 is shown intermediate the house 40. In this FIG. 2B, the top portions 11 of each of the erosion control planks 10 are shown in the grass area 70. The bottoms 13 of each of the erosion control planks 10 are shown in the low level of water 55 of the lake, canal or pond 50. Hereinafter, the terms lake, canal, or pond are used interchangeably and can refer to any body of water.

FIG. 2B shows three of the erosion planks of the second embodiment affixed together. The first erosion control plank 10 has a top side A, a bottom side B, a right side C and a left side D.

The second erosion control plank 10' has a top side A', a bottom side B', a right side C' and a left side D'.

The third erosion control plank 10" has a top side A", a bottom side B", a right side C" and a left side D". The arrangement of the erosion control planks (10, 10', 10") are long sides adjacent the long sides (C next to D') and (C' next to D").

Figure 3B:
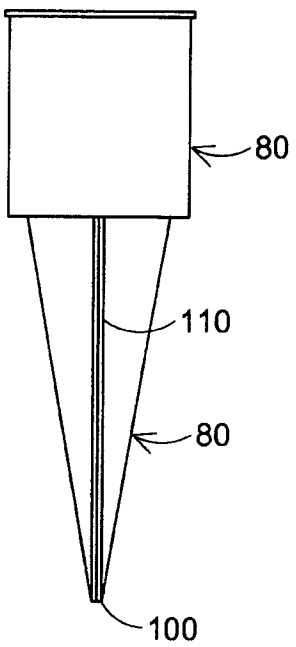
FIG. 3B is an end view of the stakes of FIG. 3A.
Figure 3A:
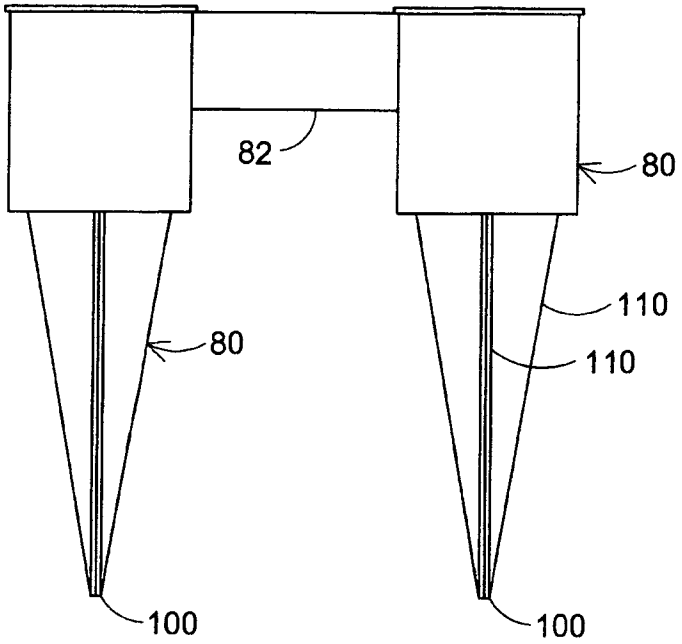
FIG. 3A is a front view of a connected pair of stakes, these stakes would be employed in connecting one erosion control plank to another in the second embodiment of the invention.

The first and second erosion control planks 10 and 10' are connected by a pair of connecting stakes 80 (best seen in detail in FIGS. 3A and 3B. Two pairs of connecting stakes 80 connect the top portion A to A' and then A' to A". Another two pair of connecting stakes 80 connect the bottom portion B to B' and then B' to B" as shown. In the embodiment shown in FIG. 2B, each square of the lattice 12 is about 4 by 4 inches.

One of the pair of stakes 80 is designed to be hammered into or by other means inserted through the rightmost top square cell 85 of the lattice of the erosion control plank 10 into the ground below. The other one of the pair of stakes 80 is to be hammered or by other means inserted through the leftmost top square cell 86 of the lattice of the erosion control plank 10'. Each one of the stakes in the pair of stakes 80 is connected to the other by a connecting element 82. The connecting element 82 in this embodiment is 4 inches long. This separates the first erosion control plank 10 from the second erosion control plank 10' by 4 inches.

A second pair of stakes 80 is designed to be hammered into or by other means inserted through the rightmost top square cell 93' of the lattice of the erosion control plank 10' into the ground below. The other one of the pair of stakes 80 is to be hammered or by other means inserted through the leftmost top square cell 94" of the lattice of the erosion control plank 10". Each one of the stakes in the second pair of stakes 80 is connected to the other by a connecting element 82. The connecting element 82 in this embodiment is 4 inches long. This separates the second erosion control plank 10' from the third erosion control plank 10" by 4 inches.

A third pair of stakes 80 is designed to be hammered into or by other means inserted through the rightmost bottom square cell 87 of the lattice of the erosion control plank 10 into the ground below. The other one of the pair of stakes 80 is to be hammered or by other means inserted through the leftmost bottom square cell 88 of the lattice of the erosion control plank 10'. Each one of the stakes in the pair of stakes 80 is connected to the other by a connecting element 82. The connecting element 82 in this embodiment is 4 inches long. This separates the first erosion control plank 10 from the second erosion control plank 10' by 4 inches.

A fourth pair of stakes 80 is designed to be hammered into or by other means inserted through the rightmost lower square cell 90 of the lattice of the erosion control plank 10' into the ground below. The other one of the pair of stakes 80 is to be hammered or by other means inserted through the leftmost bottom square cell 91 of the lattice of the erosion control plank 10". Each one of the stakes in the second pair of stakes 80 is connected to the other by a connecting element 82. The connecting element 82 in this embodiment is 4 inches long. This separates the second erosion control plank 10' from the third erosion control plank 10" by about 4 inches.

By use of the connecting stakes 80 the erosion control planks 10, 10' and 10" are secured in position above the eroded area 60. When initially placing the erosion control planks 10, 10' and 10" the perimeter of each, designated by sides (A,B,C,D), (A'B'C'D') and (A"B"C"D") respectfully, and the respective portions of the planks 10, 10' and 10" are forced into ground in the region of or adjacent the eroded area 60, whether it be grass, gravel, sand, water or whatever. This is done prior to the placing stakes 80 to secure the erosion control planks (10, 10', 10") over and in the eroded area 60.

This is able to be accomplished because the downward axial compressive force does not exceed the compressive force properties of the material from which the erosion control planks (10, 10', 10") were chosen to be constructed from. The erosion control planks 10, 10' and 10" are manufactured from any of a plurality of modern high strength plastics or other material which may have appropriate material properties to be employed including recycled materials. Different materials may be employed in different environmental circumstances. Any number of erosion control planks 10 can be interconnected. By using different lattice squares to place the stakes 80 both vertical and horizontal designs may be utilized to cover the eroded region 60. Once the eroded region 60 is covered with a sufficient number of erosion control planks 10, a fill material is placed through the square apertures of the lattice filling the eroded region 60. The fill material may be sand, crushed rocks, dirt, or other materials which may pass through the lattice and fill the eroded region 60 below. This fill may be employed in any embodiment of the invention, and may be chosen due to the local environmental conditions. Whatever material is employed it is to be filled to the top or close to the top of the erosion control plank 10. At this point rolls of sod or the like are placed atop the region where the erosion control planks have been placed. This sod would be watered and once the roots take hold, the erosion into the lake or pond will have been halted or minimized. Thus the property and the house will be protected from heavy rains and flooding through the arresting of the erosion through the use of the erosion control plank 10. In addition to the sod, not shown, plants 240 can be placed in and on top of the planks after the fill is placed below and in the planks.

Referring to FIG. 3A a front view of the connected pair of stakes 80 are shown. They are connected by element 82 and in this embodiment, element 82 is 4 inches long. FIG. 3B is an end view of the stakes of FIG. 3A. The stakes 80 have a pointed bottom element 100. Angular fins 110 are provided about the stake 80. It has been considered that since the sod and grass will root and secure the erosion control board 10 that the stake 80 be manufactured in eco-friendly fashion or may be biodegradable, likewise the planks herein all embodiments can be biodegradable.

Figure 4:
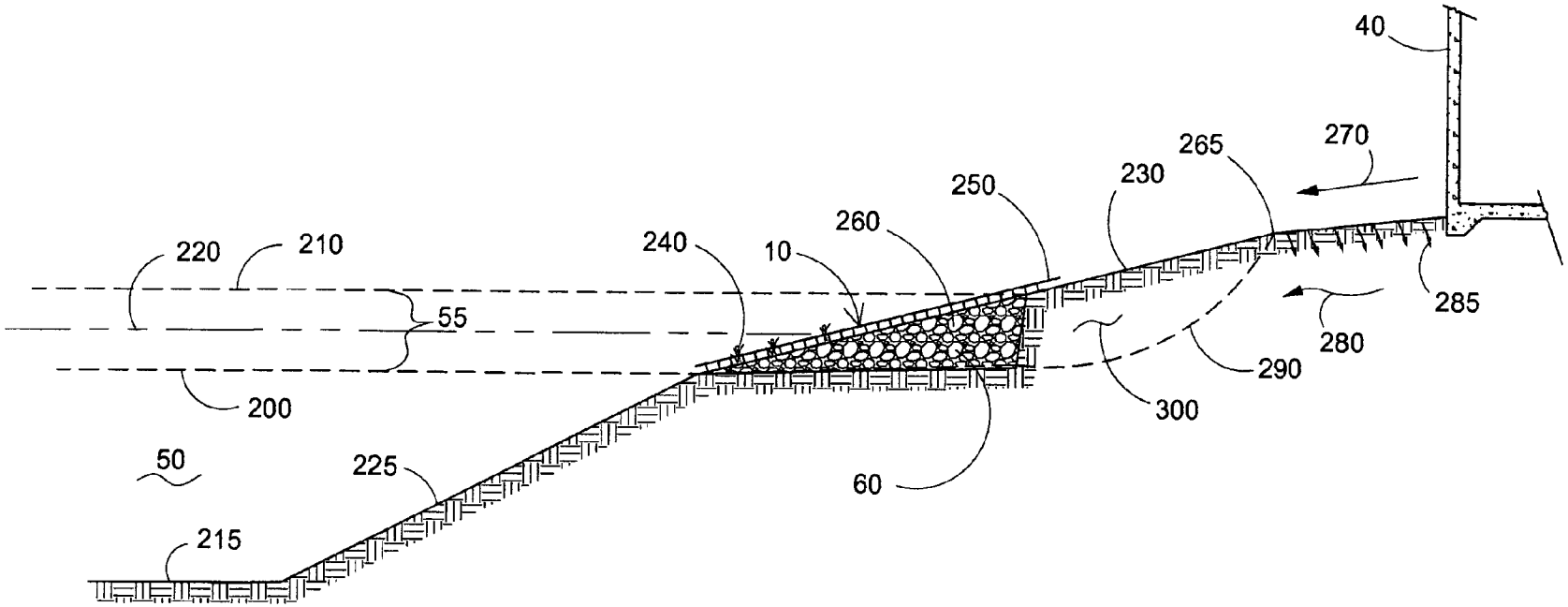
FIG. 4 shows a side cross sectional view taken from a building to the lake, canal or pond, showing the implementation of the second embodiment of the erosion control planks, restoring a stable slope where an eroded region once existed.
Figure 5:
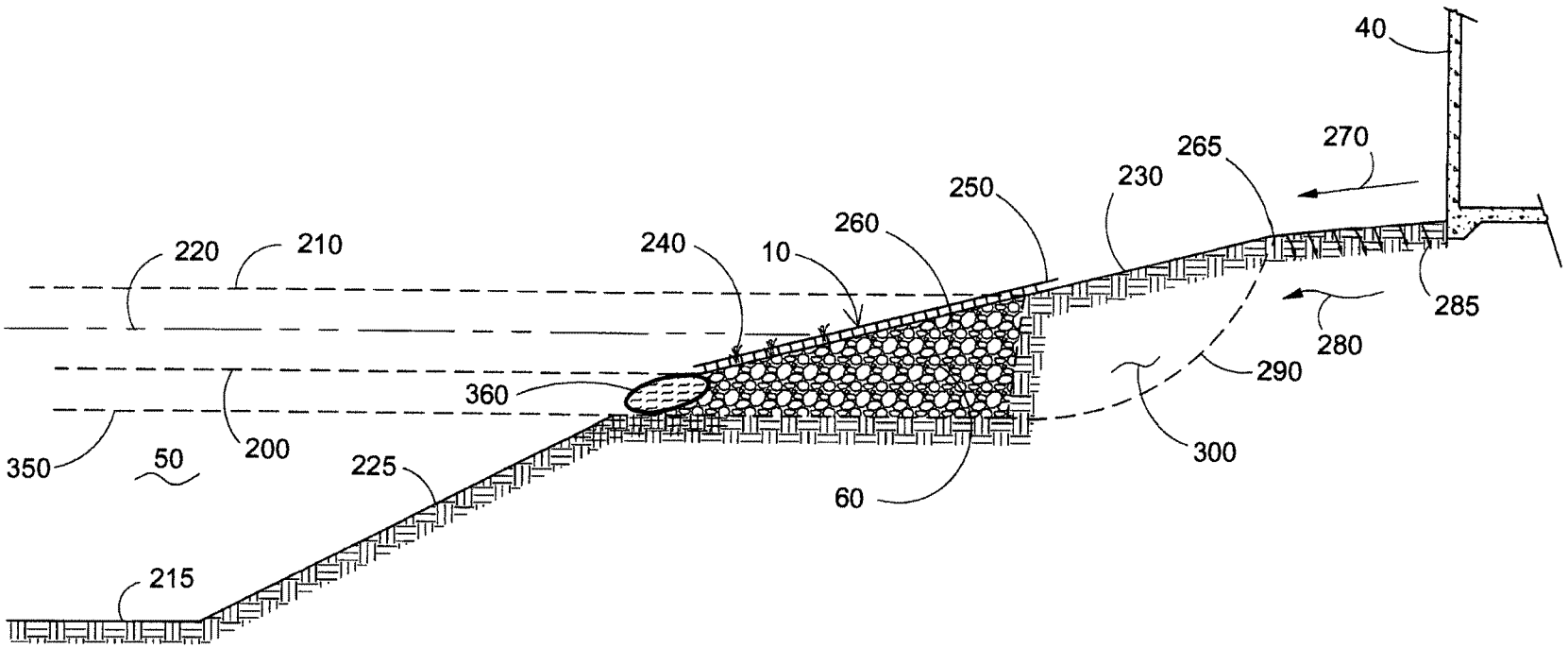
FIG. 5 shows a side cross sectional view of taken from a building to the lake, canal or pond, showing the implementation of another embodiment of the erosion control planks, including a tube filled with material which is covered by fabric to prevent the loss of material used to fill the eroded region.

Referring now specifically to FIGS. 4 and 5 side sectional views of the landscape from the pond, canal or lake 50 to the house/building/structure 40 is shown. The lake 50 has a variable depth of water 55. The Low Water Table 200 (hereafter referred to the LWT 200) is about the lowest depth the pond/lake 50 would achieve. The High Water Table 210 (hereafter referred to as the HWT) is about the highest depth the lake 50 would achieve. Intermediate the LWT 200 and the HWT 210 is the Design Water Table 220 (hereafter referred to as the DWT) where the lake level 55 is indicated. The bottom 215 of the lake 50 is generally flat, but can be any cross section, and would have the deepest water in the lake 50. A 2:1 slope 225 comes off the bottom 215 of the lake 50 until it passes the LWT 200. Approximately at the LWT 200 the 2:1 slope 225 becomes less inclined to about a 4:1 slope 230. The erosion control planks 10 are designed to have their bottom (see B, B', and B" in FIG. 2B) placed at approximately at the DWT 220. The planks 10 would be forced into the surface of the ground all the way to the tops (A, A', A" in FIG. 2B) and then secured by the stake pairs 80 (best seen in FIGS. 3A and 3B). The eroded area 60 under the erosion control planks 10 are filled with sand 260 or other appropriate fill material which fills and shapes the eroded area 60. This appropriate fill material 260 may be compacted to 98% density at optimum moisture. Grass sod 240 is rolled atop the erosion control planks 10 covering them completely even in the area between the HWT 210 and the LWT 200. The grass sod 240 is applied in such a fashion that it matches the existing grade 250 which meets the 2:1 slope 225. At point 265 the slope becomes reasonably flat and this is where the house or building 40 would be. Between the building 40, during the rain, runoff 270 would both be absorbed into the subsurface 280. Under the 4:1 slope is a slip surface 290. The slip surface 290 is an underground boundary between stable soil 285 and an unstable block 300. Prior to the introduction of the erosion control planks 10, the material in the unstable block 300 could have moved about the slip surface 290 in the eroded area 60. However, due to the introduction of the erosion control planks 10, the 4:1 slope 230 is stable as well as the previously eroded area 60.

FIG. 5 shows a fairly similar landscape to that which is shown in FIG. 4. In this case, however, there is an extremely eroded condition 350. In this case, a filter tube 360 filled with a material, is first placed at the bottom of the eroded area 60. Then the erosion control planks 10 are introduced on the tube 360 and over the eroded area 60 which is then filled with sand, gravel or other appropriate fill material. The tube 360 is fitted with attachment points for the planks (not shown). The special fabric of the tube 360 allows only water to permeate the tube 360, but not the sand, gravel or other suitable material that was placed there during the installation of the erosion control planks 10. The tube 360 is filled with material to arrest the material from eroding. This tube 360 variant may be utilized in areas where more rain falls on the average.

Figure 6B:
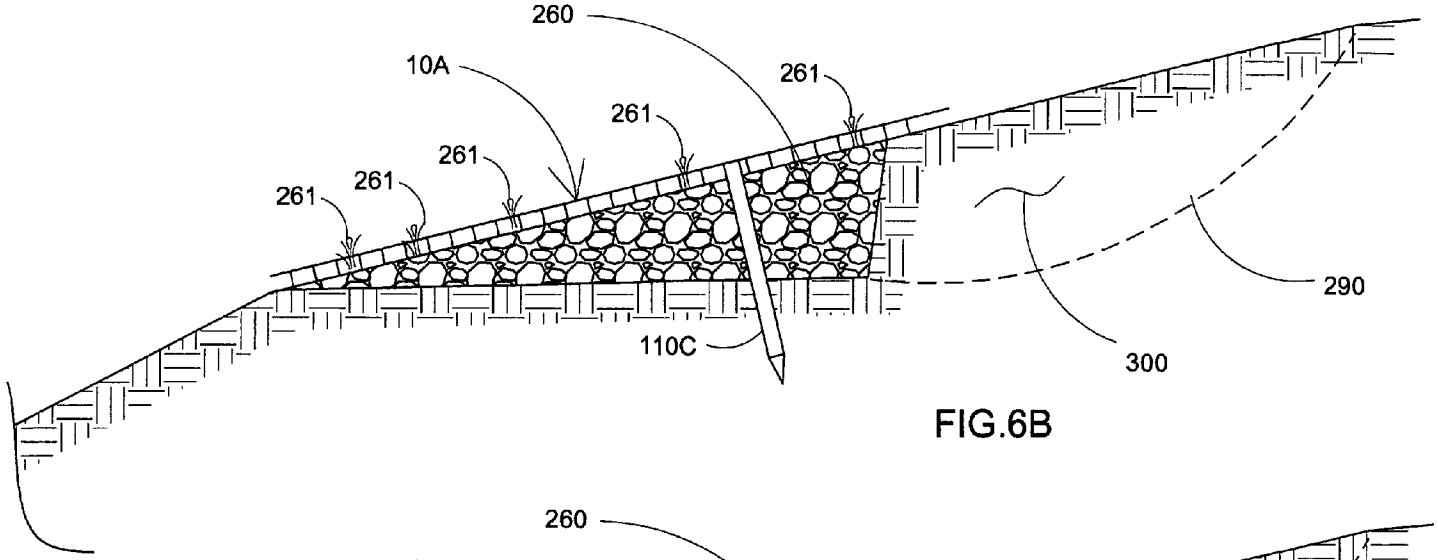
FIG. 6B shows a side cross sectional view taken from above the erosion zone to the lake, canal or pond, showing the implementation of the first embodiment of the erosion control planks, including a single large stake which passes through the eroded zone and is embedded into the sub-eroded zone.
Figure 6A:
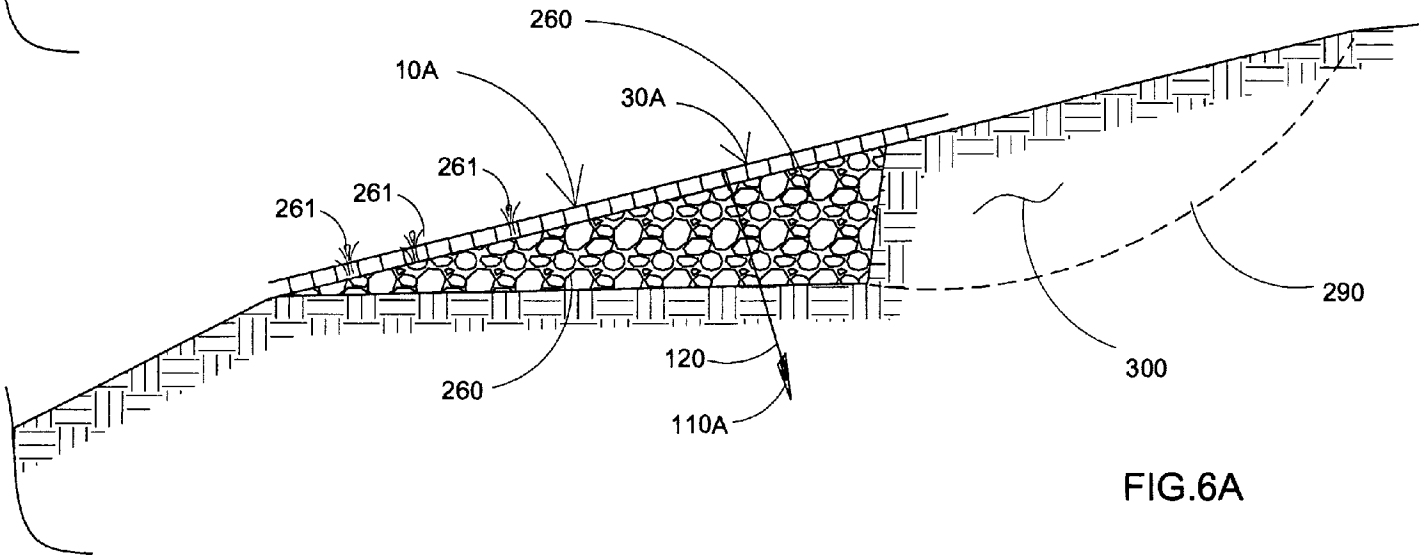
FIG. 6A shows a side cross sectional view taken from above the erosion zone to the lake, canal or pond, showing the implementation of the first embodiment of the erosion control plank, including a deeply buried stake connected by a cord to the central aperture in each of the connected erosion control planks.

FIG. 6A shows a side sectional view taken from above the erosion zone to the lake, canal or pond, showing the implementation of the first embodiment of the erosion control plank 10A, including a deeply buried stake 110A connected by a cord or rope 120 to the notch 100B in the cylindrical aperture 30A in each of the connected erosion control plank 10A. The fill 260 is shown completely filling the previously eroded area and a plurality of plants 261 have been introduced so that they may grow and their root systems will aid in anchoring the erosion control plank 10A in place. Plants 261 may be used in conjunction with previously discussed sod, or on top of the sod or in the sod.

FIG. 6B shows a side sectional view taken from above the erosion zone to the lake, canal or pond, showing the implementation of the first embodiment of the erosion control plank, including a single large stake 110C which passes through any of the cells of the plank and the top of stake 110C engages a vertical wall or a horizontal wall or both a vertical wall and a horizontal wall at its upper end and the other end passes through the eroded zone and is securely embedded into the sub-eroded zone. The fill 260 is shown completely filling the previously eroded area and a plurality of plants 261 have been introduced so that they may grow and their root systems will aid in anchoring the erosion control plank 10A in place.

FIG. 7 is a perspective view of the first embodiment of the erosion control plank 10A and is discussed in detail concurrently with the discussion of FIG. 1A.

Figure 8A:
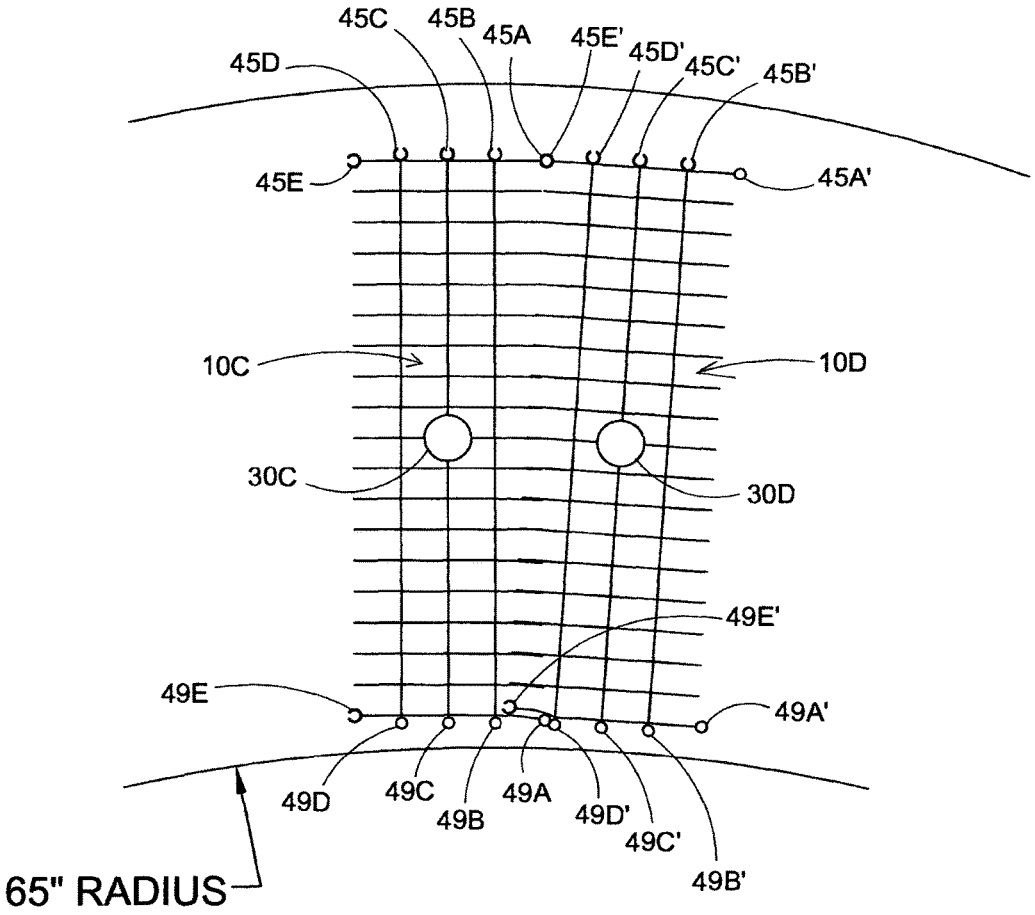
FIG. 8A is a plan view of two connected erosion control planks of the first embodiment of the invention, showing their ability to form a concave curve to more completely cover a concave eroded zone formed proximal to the intersection of a concave curved perimeter of a lake, stream, canal ocean or pond with associated land.

FIG. 8A is a plan view of two connected erosion control planks of the first embodiment of the invention, the first erosion control plank 10C and the second erosion control plank 10D. Erosion control plank 10C is connected to erosion control plank 10D by the top rightmost male connection member 45A (of plank 10C) matingly engaging the top leftmost female connection member 45E' (of Plank 10D). The bottom of erosion control plank 10C is pulled to the right and the bottom of erosion control plank 10D is pulled to the left, pivoting about the intersection of the connection elements 45A and 45E'. This causes the plurality of vertical walls of the lattice of plank 10C to no longer be in parallel relation to the respective vertical walls of plank 10D. Further, the plurality of horizontal walls of plank 10C begin to overlap the plurality of horizontal walls of plank 10D on their right and left side respectively, the overlap increasing in magnitude from the top of both planks 10C and 10D to the bottom of both planks 10C and 10D. This causes the bottom leftmost female connection element 49E' to not be able to connect to the rightmost male connection element 49A. Due to the arrangement of male and female connection elements at the bottom of both planks 10C and 10D, none of the connection elements connect. The planks 10C and 10D can be kept in this concave position, if necessary by the stake 110A or stake 110C being secured to the respective plank 10A, where the stakes 110A or 110C pass through the voided eroded region (which would have a concave erosion pattern) securely into the non-eroded region below the voided erosion region. As before, fill is introduced through the lattice openings and fills the voided erosion region to the top of the lattice walls further securing the planks 10C and 10D in a concave position in order that the bottom portions of the respective planks 10A can conform to a concave area of a lake or water shore edge. Plants and the like are then introduced into the connected planks latticework and as they grow the root structure firmly anchors the erosion control planks in place. The placing of the erosion control plank 10A in such a concave position shows their ability to form a concave curve to more completely cover a concave eroded zone formed proximal to the intersection of a concave curved perimeter of a lake, stream, canal ocean or pond.

Figure 8B:
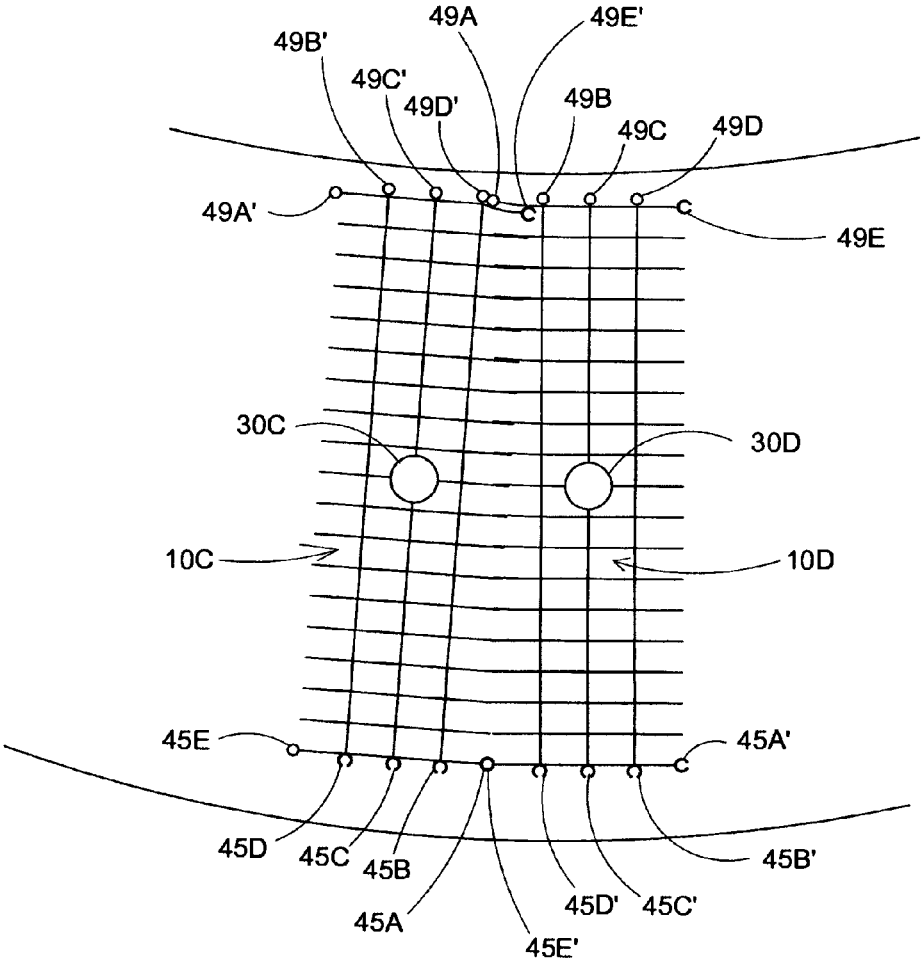
FIG. 8B is a plan view of two connected erosion control planks of the first embodiment of the invention, showing their ability to form a convex curve to more completely cover a convex eroded zone formed proximal to the intersection of a convex curved perimeter of a lake, stream, canal ocean or pond with associated land.

FIG. 8B is a plan view of two connected erosion control planks of the first embodiment of the invention, the first erosion control plank 10C and the second erosion control plank 10D. Erosion control plank 10C is connected to erosion control plank 10D by the bottom rightmost male connection member 45A (of plank 10C) matingly engaging the bottom leftmost female connection member 45E' (of Plank 10D). The top of erosion control plank 10C is pulled to the right and the top of erosion control plank 10D is pulled to the left, pivoting about the intersection of the connection elements 45A and 45E'. This causes the plurality of vertical walls of the lattice of plank 10C to no longer be in parallel relation with the plurality of vertical walls of plank 10D. Further, the plurality of horizontal walls of plank 10C begin to overlap the plurality of horizontal walls of plank 10D on their right and left side respectively, the overlap increasing in magnitude from the bottom of both planks 10C and 10D to the top of both planks 10C and 10D. This causes the top rightmost female connection element 49E' to not be able to connect to the rightmost male connection element 49A. Due to the arrangement of male and female connection elements at the top of both planks 10C and 10D, none of the top connection elements connect. The planks 10C and 10D can be kept in this convex position by a stakes 110A or 110C being secured to the respective plank 10A where the stakes 110A and 110C pass through the voided eroded region (which would have a concave erosion pattern) securely into the non-eroded region below the voided erosion region. As before, fill is introduced through the lattice openings and fills the voided erosion region to the top of the lattice walls further securing the planks 10C and 10D in a convex position. Plants and the like are then introduced into the connected planks latticework and as they grow the root structure firmly anchors the erosion control planks in place. The placing of the erosion control plank 10A in such a concave position shows their ability to form a concave curve to more completely cover a convex eroded zone formed proximal to the intersection of a convex curved perimeter of a lake, stream, canal ocean or pond.

It is to be understood that the erosion control plank 10A can be arranged in combinations of convex and concave orientations to follow an erosion zone of a serpentine stream, river or other non linear water source which causes erosion.

Figure 9A:
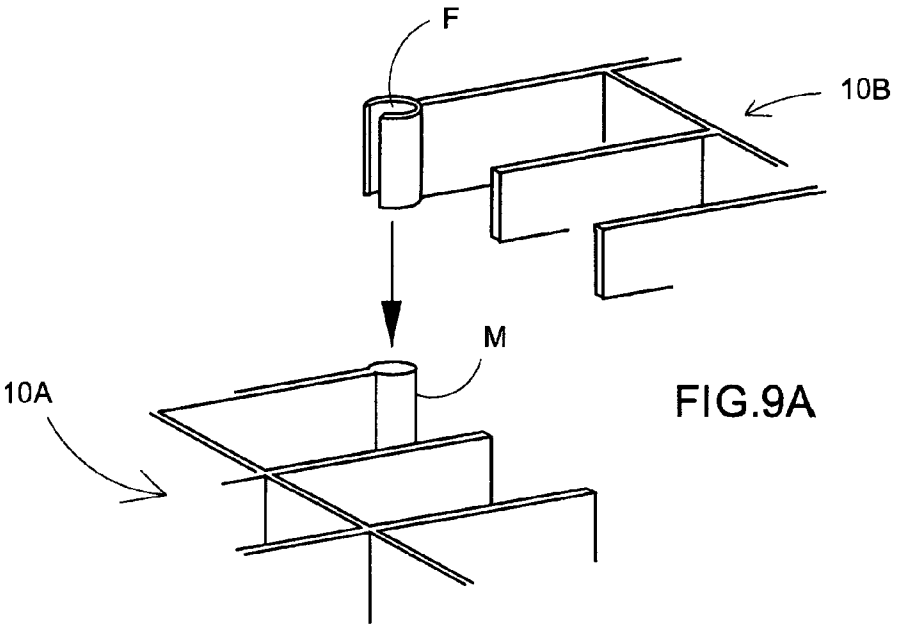
FIG. 9A is a view of the first embodiment of the invention showing the female portion just prior to connection to the male portion of the connecting elements.

Referring now specifically to FIG. 9A, erosion control plank 10A is about to be connected to erosion control plank 10B. The male connector element M of plank 10A is shown prior to being placed in the female connector element F of plank 10B.

Figure 9B:
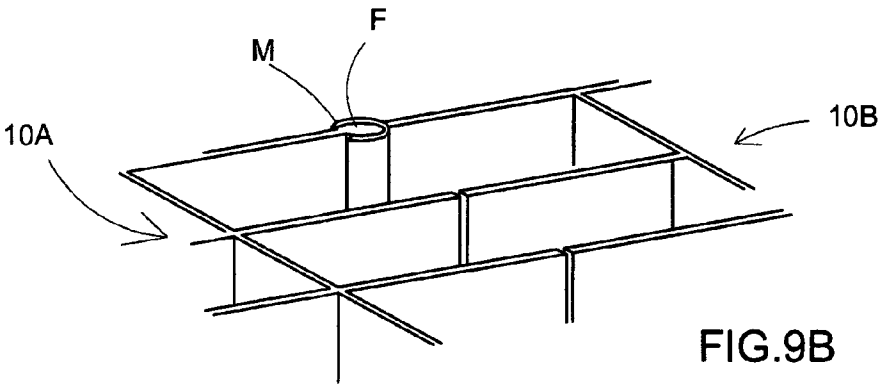
FIG. 9B is a view of the first embodiment of the invention showing the female portion connected to the male portion of the connecting elements.

Referring now to FIG. 9B, erosion control plank 10A is shown connected to erosion control plank 10B by the mating engagement of the male connector element M of plank 10A into the female connector element F of 10B. By such mating engagement any number of erosion control planks may be attached to cover even very larger eroded areas. It is also to be understood that the instant invention may be employed in areas in which erosion may not yet have occurred, thus not repairing an eroded area but preventing the area from ever suffering from erosion.

Figure 10:
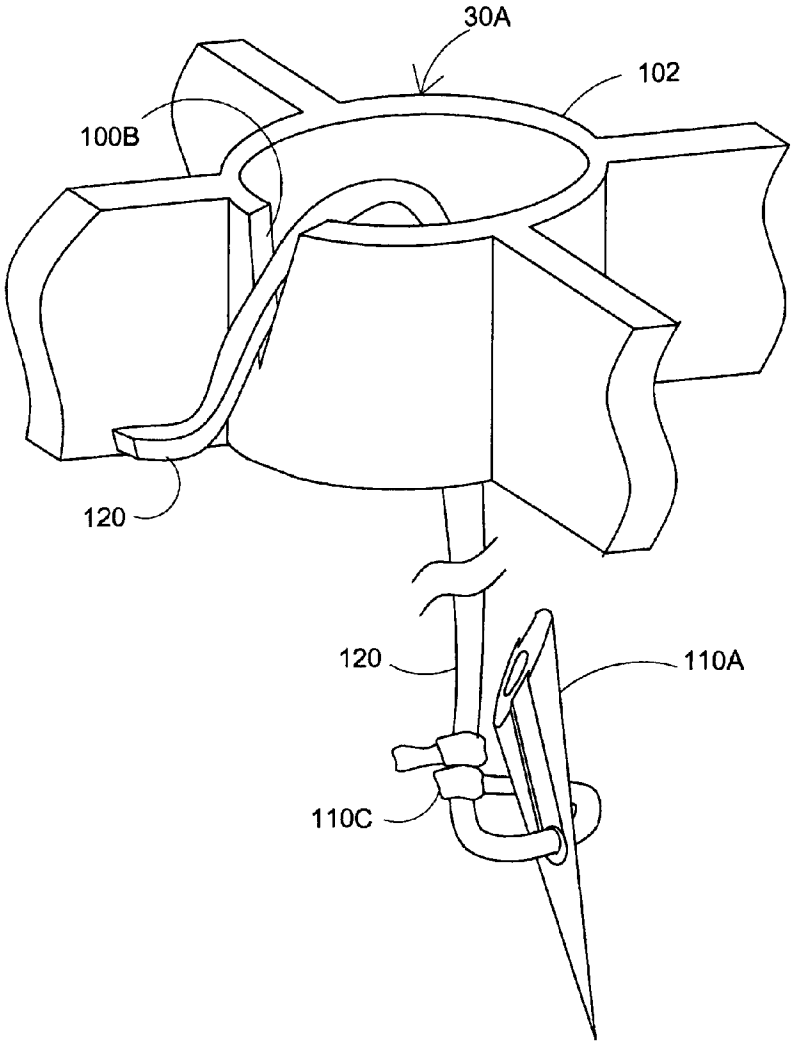
FIG. 10 shows a stake connected to the central aperture of the first embodiment of an erosion control plank, where the stake is connected to the central aperture by a rope frictionally fit in a v-notch located on the wall of the aperture, and the rope is securely affixed to the stake.

FIG. 10 shows the cylindrical aperture 30A with a cylindrical sidewall 102. Cut into the top side of the cylindrical sidewall 102 is a notch 100B. A piece of rope 120 or the like is connected to a stake 110A. The rope 120 may be secured about the stake 110A by a knot 110C. The top portion of the rope 120 is cinched into the notch 100B, securing it to the cylindrical sidewall 102. Other means may be employed to use the cylindrical aperture 30A with a stake of another configuration to secure the erosion control plank 10A to the ground below an eroded region. As known in the art, the stake 110A is driven into the ground by an elongated rod until stake 110A is at a desired depth in the ground. The rope 120 is then secured to plank 10A at notch 100B.

Figure 11:
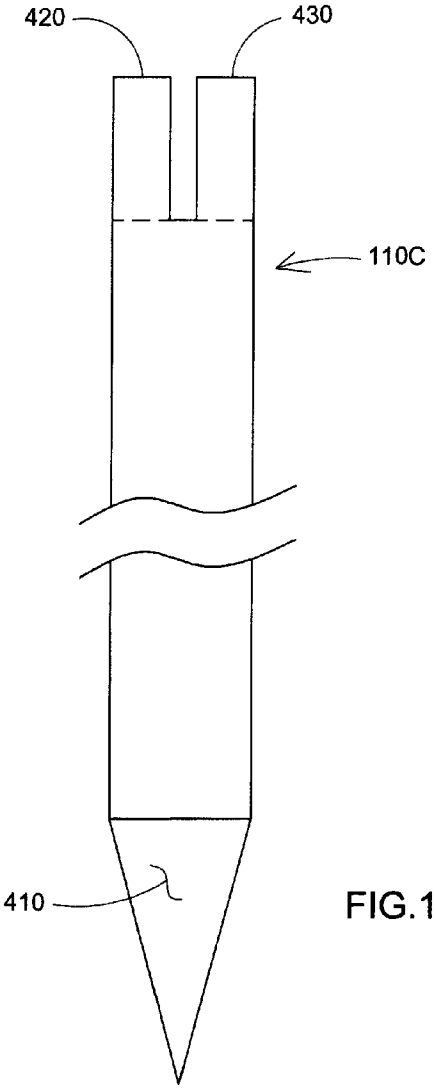
FIG. 11 shows a broken view of another type of stake which would interfit with the lattice of the erosion control plank.

FIG. 11 shows a broken view of another type of stake 110C which would interfit with the lattice of the erosion control plank. The point 410 of stake 400 would penetrate the soil below the void created by the erosion. A first turret 420 and a second turret 430 can be seen in FIG. 11.

Figure 12:
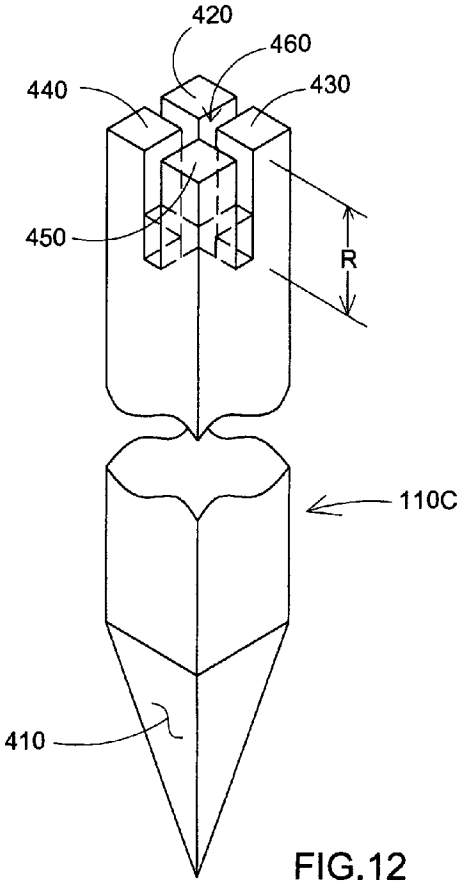
FIG. 12 shows a broken perspective view of another type of stake as shown in FIG. 11.

FIG. 12 shows a broken perspective view of another type of stake as shown in FIG. 11. FIG. 12 shows the first turret 420, the second turret 430, the third turret 440 and the fourth turret 450. A generally "+" shaped aperture 460 separates the four turrets from one another forming four corners, and proceeds a distance R down from the top of the stake 400. A plurality of stakes 400 would be placed into to substrate below the eroded region so that the top of the stakes 400 would be level with one another. The erosion control planks 10 or 10' may be placed atop the plurality of stakes 400 which are appropriately placed to receive the intersections of the vertical columns with the horizontal rows, providing a support for the erosion control planks 10 or 10' prior to the eroded zone being filled with fill. Once the fill integrates the void formed by the erosion back to a non-eroded state, plants and the like would be placed in the lattice cells where the root growth would secure the erosion control planks 10 or 10' permanently in position to resist future erosion events.

FIG. 13 shows three erosion control planks 10R, 10S, and 10T connected together.

Erosion control plank 10R is connected to erosion control plank 10T in a vertical arrangement by three matingly engaging male and female connection elements, first, 49B and 45B', second, 49C and 45C' and third, 49D and 45D'.

Erosion control plank 10R is connected to erosion control plank 10S by a single matingly engaging male and female connection elements, namely 49E' and 49A.

While the invention has been described in its preferred form or embodiment with some degree of particularity, it is understood that this description has been given only by way of example and that numerous changes in the details of construction, sizes, fabrication, and use, including the combination and arrangement of parts, may be made without departing from the spirit and scope of the invention.

I claim:

1. An erosion control device comprising:

a rectangular plank having an outer periphery defined by four linear outermost walls interconnected at four continuous corner joints;

first parallel inner walls spanning between opposite ones of said outermost walls, said first parallel inner walls terminating at said opposite ones of said outermost walls in respective continuous joints;

second parallel inner walls spanning between second and opposite ones of said outermost walls, said second parallel inner walls terminating at said second opposite ones of said outermost walls in second respective continuous joints;

said first and second parallel inner walls intersecting one another at third continuous joints;

said first and second parallel walls having a same height; and said first and second parallel walls and said outermost walls defining a lattice of closed cells, each of said closed cells having openings on opposite sides of said plank, said openings being delimited by said first and second parallel walls; and fill material disposed in said closed cells, said closed cells being closed from one another with respect to said fill material.

2. The erosion control device according to claim 1 wherein said lattice of closed cells is a linear lattice.

3. The erosion control device according to claim 1 wherein end edges of said first and second parallel inner walls define a planar base surface.

4. An erosion control device comprising:

a rectangular plank having an outer periphery defined by four linear outermost walls interconnected at four continuous corner joints;

first parallel inner walls spanning between opposite ones of said outermost walls, said first parallel inner walls terminating at said opposite ones of said outermost walls in respective continuous joints;

second parallel inner walls spanning between second and opposite ones of said outermost walls, said second parallel inner walls terminating at said second opposite ones of said outermost walls in second respective continuous joints;

said first and second parallel inner walls intersecting one another at third continuous joints;

said first and second parallel inner walls having a height that is greater than a width of said first and second parallel inner walls; and said first and second parallel walls and said outermost walls defining a lattice of closed cells, each of said closed cells having openings on opposite sides of said plank, said openings being delimited by said first and second parallel walls; and fill material disposed in said closed cells, said closed cells being closed from one another with respect to said fill material.

5. An erosion control device comprising:

a rectangular planar plank having an outer periphery defined by four linear outermost walls interconnected at four continuous corner joints;

first parallel inner walls spanning between opposite ones of said outermost walls, said first parallel inner walls terminating at said opposite ones of said outermost walls in respective continuous joints;

second parallel inner walls spanning between second and opposite ones of said outermost walls, said second parallel inner walls terminating at said second opposite ones of said outermost walls in second respective continuous joints;

said first and second parallel inner walls intersecting one another at third continuous joints;

said first and second parallel walls having a same height; and said first and second parallel walls and said outermost walls defining a lattice of closed cells, each of said closed cells having openings on opposite sides of said plank, said openings being delimited by said first and second parallel walls; and fill material disposed in said closed cells, said closed cells being closed from one another with respect to said fill material.

6. The erosion control device according to claim 5 wherein said lattice of closed cells is a linear lattice.

7. The erosion control device according to claim 5 wherein said first and second parallel inner walls have a height that is greater than a width of said first and second parallel inner walls.

8. The erosion control device according to claim 5 wherein end edges of said first and second parallel inner walls define a planar base surface.

* * * * *